United States Patent [19]

Urdea

[11] 4,455,016

[45] Jun. 19, 1984

[54] CONVERTIBLE MELTING FURNACE

[76] Inventor: Myron G. Urdea, 9772 Mariposa Ave., Fountain Valley, Calif. 92708

[21] Appl. No.: 423,058

[22] Filed: Sep. 24, 1982

[51] Int. Cl.[3] ..... F27B 14/14

[52] U.S. Cl. ..... 266/156; 266/242; 432/158

[58] Field of Search ..... 266/156, 157, 242, 900, 266/901; 75/65 R, 68 R; 432/156, 158

[56] References Cited

U.S. PATENT DOCUMENTS

| | | | |
|---|---|---|---|
| 814,769 | 3/1906 | Cline | 432/156 |
| 1,013,472 | 1/1912 | Behrens | 432/158 |
| 1,873,801 | 8/1932 | White | 432/158 |
| 2,152,446 | 3/1939 | Temple | 432/158 |
| 2,234,898 | 3/1941 | Hartmann | 266/242 |
| 2,264,740 | 12/1941 | Brown | 432/158 |

FOREIGN PATENT DOCUMENTS

| | | | |
|---|---|---|---|
| 110787 | 5/1900 | Fed. Rep. of Germany . | |
| 0175481 | 5/1904 | Fed. Rep. of Germany | 266/242 |
| 0030287 | of 1910 | United Kingdom | 432/158 |
| 0022657 | of 1913 | United Kingdom | 432/158 |

OTHER PUBLICATIONS

"Gas Fired Crucible Furnaces", by Baker Supply Company Brochure.

"Fossil Fuels or Electric-How Should You Melt?", By Society of Die Casting Engineers, Gateway Convention Center, St. Louis, Mo., Mar. 19-22, 1979; Paper No. G-T79-075.

*Primary Examiner*—L. Dewayne Rutledge
*Assistant Examiner*—S. Kastler
*Attorney, Agent, or Firm*—Knobbe, Martens, Olson & Bear

[57] ABSTRACT

A melting furnace includes a crucible surrounded by a wall to form an annular heating chamber. A burner provides a long combustion flame which circulates through the annular chamber to heat the exterior of the crucible. The combustion flame and hot gases in this chamber are exhausted through a stack having a first exhaust port at the top of the stack and a second exhaust port on the side of the stack. A duct, connected to the stack at the second port, provides a path for ducting the combustion flame and gases into the mouth of the crucible to melt a charge therein.

The first exhaust port is selectively opened and closed, as by a damper, to alternatively direct the combustion flame and gases either (a) through the first port to the atmosphere, or (b) through the second port, into the duct, and into the mouth of the crucible. When the first port is open, noxious fumes from the crucible are advantageously drawn through the duct and into the exhaust stack.

17 Claims, 3 Drawing Figures

Fig. 3
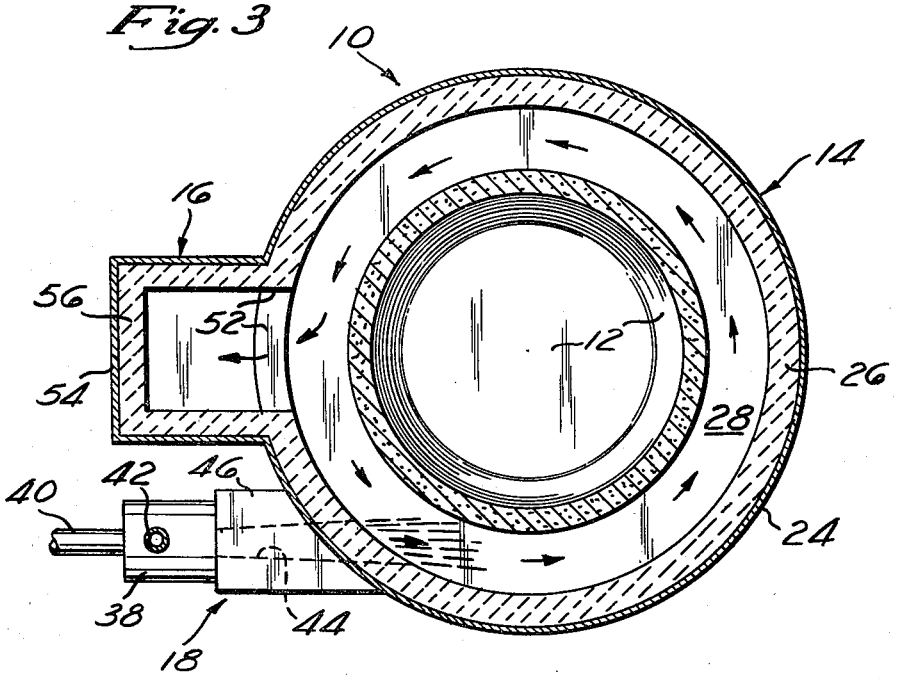
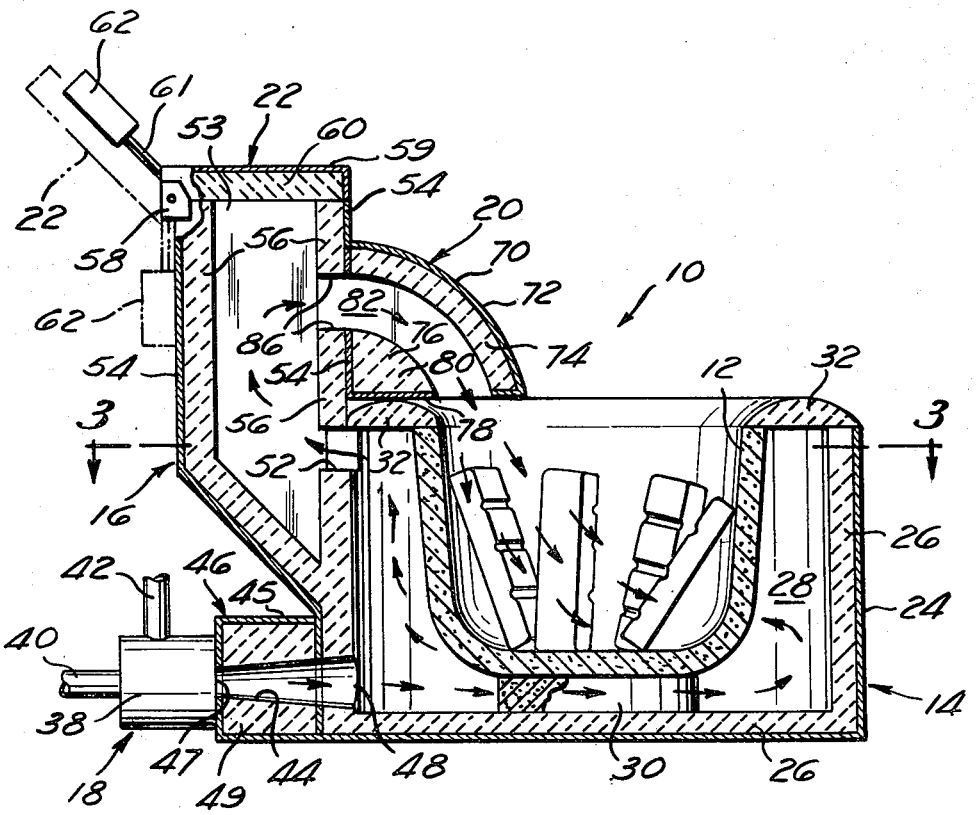
Fig. 2

CONVERTIBLE MELTING FURNACE

BACKGROUND OF THE INVENTION

The present invention relates to furnaces for melting metals.

In the melting of non-ferrous metals, such as aluminum alloys, fossil fuels (liquified gas, natural gas, and oil) are commonly utilized. The fossil fuels are mixed with air and ignited, producing a hot combustion flame and combustion gases. These products of combustion (i.e., the flame and gases), are utilized in different ways, depending upon the type of furnace, to produce the desired result of melting or breakdown of the metal charge, and then superheating to a temperature to be held for pouring.

Although many variations exist, there are two broad types of fossil fuel fired, non-ferrous metal, melting furnaces, namely, crucible and reverberatory. Each type utilizes the products of combustion in a different manner, with associated advantages and disadvantages.

Crucible furnaces are typically comprised of a cylindrical insulating/refractory wall and a crucible or pot. The insulating/refractory wall is in spaced relationship to the crucible to provide an annular heating chamber for circulating the flame and products of combustion. The most efficient furnaces utilize an enclosed barrier/-furnace interface so that the pressurized products of combustion cannot blow back out of the annular combustion space. Heating of the crucible is accomplished by the scrubbing of the flame and combustion gases along the periphery of the crucible as they travel their path to the exhaust port. The flame is preferably directed tangentially to the crucible to avoid hot spots which could shorten the life of the crucible. A vertical stack is commonly connected to the exhaust port in the insulating wall to exhaust combustion flame and gases away from the furnace operator.

One major disadvantage of these crucible furnaces is that they require a relatively long period of time to transform metal from a solid to a molten state. The relatively long melt time associated with crucible furnaces is due, in part, to the fact that the heat for melting the charge must be conducted through the crucible wall. Also, the high temperatures involved in crucible melting, as well as contamination problems associated with, e.g., ferrous, crucible materials, dictate that the crucible be constructed of refractory materials, such as silicon carbide or graphite. Such refractory materials are inherently poor conductors of heat, and thus, a substantial period of time is required to conduct sufficient heat to the interior of the crucible to melt the charge. The poor heat transfer characteristics of refractory materials make crucible furnaces extremely inefficient, and thus, tremendous amounts of energy are required for their operation. For example, one pound of aluminum requires approximately 511 BTU of energy to convert it to the molten state and then superheat it to 1400° F. (a typical pouring temperature). A typical crucible furnace requires 3,000 to 7,000 BTU to melt one pound of aluminum, thus yielding an efficiency of only about 7 to 17%.

A further disadvantage of crucible furnaces is that the crucibles are heated to extremely high temperatures from their exterior side, thereby creating high temperature gradients within the walls of the crucibles. These temperature gradients tend to cause the crucibles to fracture, typically after only 3 to 6 months of operation.

Replacement of the crucibles involves significant expense, and this adds substantially to the cost of foundry operations.

Although the crucible furnace has many disadvantages, one major advantage is flexibility. A change of alloy can be accomplished readily by emptying the crucible, scraping down the excess material from the sidewalls of the crucible, disposing of this material, and then recharging with a new alloy. This takes only a matter of minutes, and can be accomplished, for example, after every shift, if necessary. A further advantage of crucible furnaces is that they experience relatively low metal losses due to oxidation. Typically, such metal losses amount to about 3 to 5%.

In contrast to crucible furnaces, reverberatory furnaces are usually square or rectangular in shape and are comprised of a refractory hearth for holding the metal charge. The hearth is surrounded by a roof and walls having a first layer of insulating material, adjacent to the outside of the furnace, and a second layer of refractory material adjacent to the combustion zone. The burners are placed in the roof or top of the furnaces, aimed at the hearth, and separated from the hearth by a predetermined air space. The burners are also pressurized and of two distinct types: (a) luminous flame burners, or those whose flame and products of combustion tend to impinge on the surface of the metal charge and (b) radiant burners, or those that have no contact between the flame and combustion gases, and rely solely on the transfer of radiant energy from a heated ceramic shield to the charge.

Two distinct types of reverberatory furnaces are in use at the present time, (a) dry hearth, and (b) wet hearth, or wet bath. The dry hearth furnace consists of a sloped hearth on which the metal charge is placed. Upon melting, the molten metal runs down the hearth into a secondary holding chamber, that requires auxillary heating. The wet hearth has a holding chamber, having a refractory hearth upon which melting and holding takes place.

The combustion of fossil fuels result in copious quantities of hydrogen and oxygen. Hydrogen is readily absorbed by molten aluminum and is released during solidification, resulting in porosity or voids. Molten aluminum rapidly oxidizes in the presence of oxygen. Consequently, molten metal produced in a typical reverberatory furnace is usually poor in quality, yielding relatively inferior ingots and/or castings. Moreover, the oxidation results in a relatively large metal loss, typically in the range of 5 to 12% of the charged metal.

In contrast to crucible furnaces, reverberatory furnaces are relatively sufficient. For example, a typical reverberatory furnace may utilize about 1,500 to 4,000 BTU to melt one pound of a aluminum, yielding an efficiency of 12.8 to 34%. However, reverberatory furnaces do not have the flexibility of crucible furnaces, and a change of alloy can be an involved, time consuming, and costly endeavor.

Thus, crucible and reverberatory furnaces each have advantages over the other. The crucible furnace is more flexible in use, and produces a cleaner molten metal. The reverberatory furnace, on the other hand, out-performs the crucible furnace immensely in speed of melting, since heat does not have to be transferred through a wall of refractory material. While both types of furnaces have their devoted users, there exists a need for a single furnace which combines the best features of both furnace types.

SUMMARY OF THE INVENTION

The present invention alleviates the problems of the prior art by combining the best features of both furnace types in a single furnace, which is readily convertible to operate as either a crucible furnace or a reverberatory furnace. Specifically, the furnace of the present invention provides the fuel efficiency and high melting rate normally associated with reverberatory furnaces, while providing the cleanliness of a crucible furnace during superheating and holding at pouring temperatures. This is achieved by providing a duct, connected at one end to a lateral opening in the furnace stack, and having another end directed towards the mouth of a crucible. A damper, mounted on the stack, above the duct, is included to selectively open and close the top of the furnace stack. When the damper is closed, the combustion flame and gases are prevented from being exhausted out of the top of the stack, and are thereby forced through the duct and into the mouth of the crucible to heat the solid metal charge therein.

The duct is sized to constrict the path of the combustion flame and gases, and thereby create a back-pressure in the stack and furnace heating chamber. It is theorized that such back-pressure increases the turbulence of the air and fuel reactants, resulting in a more thorough mixture. Coupled with the fact that the length of the path that the combustion front must travel is increased when the damper is closed, also resulting in better mixing, two of the most important criteria required for enhancing combustion efficiency are satisified by this unique design. The resulting increase in combustion efficiency is manifested by a phenomenon referred to herein as "high stack temperature gain", wherein the temperature of the gases in the stack rise substantially. This results in extremely rapid melting of the solid metal charge. Indeed, tests have shown that the present invention requires only approximately 950 to 1,005 BTU to melt one pound of aluminum and heat it to 1400° F., yielding an efficiency of 50.8% to 53.8%. This efficiency is about three times the maximum efficiency of a typical crucible furnace (17%), and about 1½ times that of a typical reverberatory furnace (34%).

The efficiency of the furnace of the present invention dramatically decreases the time required to melt the solid metal charge. Tests show that the melt time of aluminum is decreased by about 65%. A byproduct of this decreased melt time has been to decrease fuel consumption. In one exemplary foundry operation, overall fuel usage decreased by more than 50%. This is a substantial savings, particularly in view of the fact that, in this exemplary foundry operation, the same fossil fuel used in melting was also used for other purposes, such as to preheat iron molds. Thus, if the overall savings are 50%, the percent savings attributable to melting should be even higher. Since some large foundrys have fuel bills in excess of $20,000 per month (one-quarter million dollars per year), it can be seen that the potential energy savings of the present invention are extremely significant.

Since the rate of absorption of hydrogen and the oxidation of metal is accomplished more readily in the molten state, it may be preferable, when the melting of the solid metal charge has been completed, to restore the furnace to its usual manner of operation by opening the damper to permit the combustion flame and hot combustion gases to exhaust vertically through the stack and out of the top of the stack to the atmosphere, thereby reducing perosity and voids to yield a superior quality metal. However, if some deterioration in metal quality is acceptable, as in commercial parts, any desired amount of stack flame and gases can be directed into the mouth of the crucible by adjusting the damper so that it is only partially open. Also, proper flux cover may be utilized to reduce any deliterious effects of the impingement of the products of combustion on the metal, so as to obtain maximum benefit, in terms of fuel efficiencies and melt time, from the flame and hot combustion gases.

A further advantage of the present invention is that, if the stack damper is fully open, the velocity of the combustion gases, as they flow through the open stack, will create a partial negative pressure at the lateral opening to which the duct is connected. This partial negative pressure advantageously draws noxious fumes, such as from salt fluxes, from the mouth of the crucible, through the duct and into the stack, thereby reducing potential hazards to operating personnel.

Tests have also shown that the present invention prolongs the useful life of silicon carbide crucibles by at least 100%. A similar result is expected for graphite crucibles. Such extended crucible life is believed to be due to the simultaneous heating of both the interior and exterior walls of the crucible, thereby reducing temperature gradients and associated stresses during initial phases of melting when these stresses are at their maximum.

BRIEF DESCRIPTION OF THE DRAWINGS

These and other advantages of the present invention may be more fully understood through reference to the drawings, in which:

FIG. 2 is a cross-sectional view taken along the lines 2—2 of FIG. 1 showing the sealed burner throwing a long pressurized combustion flame into the annular heating chamber, and showing the damper positioned to close the exhaust port at the top of the stack to redirect the combustion flame and hot gases into a second exhaust port, through the duct, and into the mouth of the crucible to heat the charge therein; and FIG. 3 is a cross-sectional view, taken along the lines 3—3 of FIG. 2, showing the combustion flame directed tangentially against the exterior of the crucible and circulating through the annular chamber.

DETAILED DESCRIPTION OF THE PREFERRED EMBODIMENT

Figure 1:
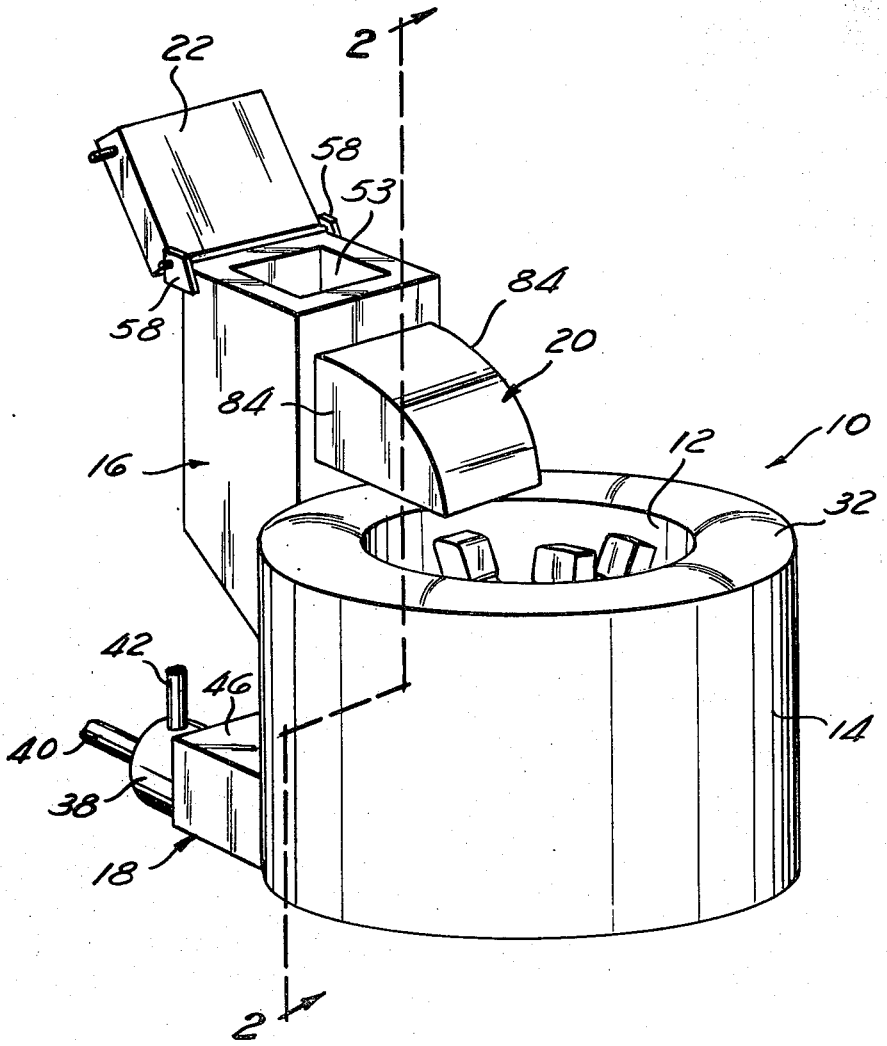
FIG. 1 is a perspective view of the crucible furnace of the present invention showing the damper for selectively opening and closing the exhaust stack and the duct for alternatively redirecting the combustion flame and hot gases (a) from the exhaust stack into the mouth of the crucible or (b) drawing fumes from the mouth of the crucible into the exhaust stack.

As shown in FIG. 1, the crucible furnace 10 of the present invention comprises a crucible 12, a crucible housing 14, a stack 16 projecting vertically from the side of the crucible housing 14, and a burner assembly 18 connected to the lower portion of the housing 14. In addition, a duct 20, projecting laterally from the stack 16, is provided for redirecting the combustion flame and hot gases into the mouth of the crucible 12. Such redirection of the combustion flame and gases is controlled by a damper or cover 22, pivotally mounted above the duct 20, e.g., on the top of the stack 16.

Referring to FIGS. 2 and 3, the crucible housing 14 includes a shell 24, formed of rigid material, such as steel, and faced on its interior surfaces with an insulating material 26, such as firebrick. The sides of the shell 24 form a cylinder which surrounds the crucible 12 in spaced relationship thereto, thereby creating an annular heating chamber 28 between the crucible 12 and housing 14. The shell 24 includes a bottom, also lined with the insulating material 26, which supports a base block 30, for example, of silicon carbide. This base block 30 supports the bottom of the crucible 12, and is positioned so that the sides of the crucible 12 are centered between the sides of the housing 14. An annular cap 32 of insulating material, such as firebrick, is provided to cover the annular opening between the top of the crucible 12 and the top of the housing 14, and thus, enclose the annular chamber 28. The burner assembly 18 is located near the bottom of the housing 14, adjacent to the stack 16, as best seen by comparing FIGS. 2 and 3. This burner assembly 18 is comprised of (a) a burner head 38, connected to a fuel supply line 40 and an air supply line 42, and (b) a combustion chamber 44, formed by a burner block 46 comprising a shell 45, faced on its interior surface with insulating material 49. The combustion chamber 44 extends from an inlet end 47, at the burner head 38, through the burner block 46 and crucible housing 14, to an outlet end 48 at the annular heating chamber 28. In addition, the combustion chamber 44 is conically shaped, with a reduced diameter portion at its inlet end 47 and an enlarged diameter portion at its outlet end 48.

The burner 18 ignites the fuel and air mixture in the combustion chamber 44 and produces a pressurized flame, directed into the annular heating chamber 28. This flame is tangential to the crucible 12 to permit it to circulate through the chamber 28, as indicated by the arrows in FIGS. 2 and 3, and thus, heat the exterior of the crucible 12 around its periphery. The burner assembly 18 is sealed to the furnace so that the pressurized products of combustion cannot blow back out of the annular heating chamber 28. An exhaust port or opening 52 is provided in the side of the housing 14, just below the annular cap 32, at the point where the stack 16 is connected to the side of the housing 14. This opening 52 permits the circulating flame and associated hot combustion gases to travel from the heating chamber 28 into the stack 16, as indicated by the arrows. Typically, the size of the opening 52 is about one square inch per 20,000 BTU of burner output.

The stack 16 is formed as a vertical shaft having an opening or discharge port 53 (FIG. 1) at the top thereof. As best seen by comparing FIGS. 2 and 3, the stack 16 is generally rectangular in cross-section, and has a more or less uniform cross-sectional area between the opening 52 and the opening 53. In the embodiment shown, this cross-sectional area of the stack 16 is about 10% greater than the area of the opening 52. Like the crucible housing 14, the stack 16 is comprised of an outer shell 54, faced on its interior surface with an insulating material 56, such as firebrick. Hinges 58 mount the damper 22 at the top of the stack 16.

The damper 22 is likewise comprised of an outer shell 59 of rigid material, such as steel, faced on its interior surface with an insulating material 60, such as firebrick. An arm 61, attached to the hinged side of the damper 22, mounts a counter-weight 62 to permit the damper 22 to be adjusted to a fully or partially opened or closed position. The fully open position is illustrated in phantom lines in FIG. 2, while the fully closed position is shown in solid lines. Although, in the embodiment shown, this damper 22 is formed as a cover or lid for the shaft 16, it will be understood that the damper 22 may be mounted in the interior of the stack 16, in a manner, for example, similar to a stove damper.

The stack 16 has a lateral opening or discharge port 86, at the point where the duct 20 is joined to the stack 16, to permit the combustion flame and gases to flow from the stack 16 through the passageway 82 formed by the duct 20, and into the mouth of the crucible 12, as shown by the arrows. In the embodiment shown, this opening 86 is the same size as the opening formed by the duct passageway 82. The opening 86 has an area less than the opening 52 to form a constriction which creates back pressure, and thus, turbulence, in the stack 16 and heating chamber 28. By way of specific example, the opening 86 may have an area equal to about 50% of the cross-sectional area of the stack 16. When the damper 22 is closed, the constriction provided by the opening 86 creates the "high stack temperature gain" phenomenon and causes the stack temperatures to rise substantially. As used herein, the term "high stack temperature gain" is defined as an increase in stack temperatures of at least 5% over the normal stack temperatures (when the damper 22 is open).

The duct 20 includes an arcuately shaped top member or hood 70, which projects laterally from the side of the stack 16 that is adjacent to the crucible housing 14. The hood 70 extends downwardly towards the mouth of the crucible 12 and terminates adjacent to this mouth, at a point approximately midway between the center of the crucible mouth and the annular cap 32. This hood 70 is comprised of a rigid outer shell 72, for example, of steel, which is faced on its interior surface with an insulating material 74, such as firebrick. The duct 20 also includes a shield member 76, connected to the stack 16, below and in spaced relationship to the hood 70, just above the annular cap 2. This shield member 76 is comprised of a horizontal plate 78, for example, of steel, which projects perpendicularly from the stack 16 a distance approximately equal to the width of the annular cap 32, and thus, terminates adjacent to the edge of the crucible 12. The shield member 76 includes a generally triangularly shaped block of insulating material 80, such as firebrick, attached to the upper surface of the horizontal plate 78 and the outer surface of the vertical stack 16. The hypotenuse portion of this triangular block 80 is arcuately contoured so that the hood 70 and shield member 76 are spaced equidistantly throughout their length to form the passage 82 therebetween. As shown in FIG. 1, side members 84 are attached to sides of the hood 70 and shield member 76 to enclose the passage 82 formed thereby.

A cover (not shown) may be provided to close the mouth of the crucible 14 and thereby reduce heat losses. In such case, the cover should include an opening, sized and oriented to permit the combustion flame and gases to flow from the passage 82, through such opening, and into the crucible mouth.

During operation of the crucible furnace 10 of the present invention, the burner 18 may be adjusted so that the entire annular chamber 28 is engulfed in flame. This causes a visible combustion flame, or "tail flame", to shoot through the opening 52 and into the stack 16. When the damper 22 is fully opened, such adjustment of the burner 18 results in a stack temperature of about 1500° to 1600° F., assuming a theoretical flame temperature at the outlet end 48 of the burner 18 of approximately 3250° to 3350° F. However, when the damper 22 is fully closed, as shown in solid lines in FIG. 2, the stack temperatures rise, in accordance with the above-discussed "stack temperature gain" phenomenon, to about 1850° F., an increase of about 24%. With the damper 22 closed, the tail flame engulfs the stack 16 and duct 20, so that the tail flame and hot combustion gases are forced through the passageway 82 of the duct 20 and down into the mouth of crucible 12 to melt the charge therein. Since the melt temperature of most non-ferrous metals is well below 1850° F. (aluminum metals at about 1200° F.), this combustion flame and gases, together with the heat conducted through the wall of the crucible 12, melt the charge very rapidly. Tests comparing the furnace 10 of the present invention with standard crucible furnaces indicate that the melt time of aluminum is decreased by about 65% and that fuel consumption is reduced by more than 50%. Further, since the furnace 10 permits the crucible 12 to be heated from both sides simultaneously, thermal gradients between the interior and exterior walls of the crucible 12 and associated stresses are reduced, thereby prolonging the crucible life. Test results indicate that the present invention may extend crucible life by more than 100%.

The amount of heat directed through the duct 20, into the crucible mouth, may be decreased by at least partially opening the damper 22 to permit at least a portion of the tail flame and hot gases to exhaust out of the top opening 53 of the stack 16. However, after the charge has been melted, the heat conducted through the crucible walls is normally adequate to maintain the metal in a molten condition. In such case, it may be preferable to fully open the damper 22 to prevent the tail flame and/or hot gases from impinging on the surface of the molten metal, and thus, reduce hydrogen absorption and oxidation of the metal. With the damper 22 fully open, the velocity of upward flow of the hot gases through the stack 16 creates a partial vacuum at the opening 86. Such partial vacuum advantageously draws fumes from the mouth of the crucible 12, through the passage 82, and into the stack 16, and thereby reduces potential hazards to operating personnel working near the furnace. Those skilled in the art will recognize that such partial vacuum may be increased by attaching a small deflector, projecting laterally from the interior sidewall of the stack 16, near the bottom of the opening 86.

What is claimed is:

1. A crucible furnace for melting metals comprising:

a crucible;

a housing, surrounding said crucible, and having a single exhaust port therein, on one side thereof, for exhausting gases, said housing including a wall portion in spaced relationship to said crucible to form a chamber therebetween and a permanently mounted cap portion for permanently sealing between said wall and the top of said crucible, said housing completely enclosing said chamber except at said single exhaust port;

a burner for producing a pressurized combustion flame, said flame directed into said chamber, tangential to said crucible, and circulating through said chamber to heat said crucible;

an exhaust stack, external to said housing, and connected thereto at said exhaust port, for conducting hot gases from said chamber, said stack having a first stack discharge port for exhausting said gases in said stack through a first path to the atmosphere, and a second stack discharge port;

a duct, permanently mounted on the exterior of said exhaust stack at said second stack discharge port, for directing said gases in said stack through a second path into the top of said crucible; and means, mounted on said exhaust stack, for controlling the flow of exhaust gases through said first path to selectively force said gases through said second path.

2. A crucible furnace, as defined in claim 1, wherein said controlling means comprises a damper, permanently mounted on said exhaust stack, for selectively closing said first stack discharge port.

3. A crucible furnace, as defined in claim 1, wherein said duct additionally comprises means for drawing fumes from the mouth of said crucible when said damper is in said first position.

4. A crucible furnace, as defined in claim 1, wherein said crucible is formed from a refractory material.

5. A crucible furnace, as defined in claim 1, wherein the area of said second discharge port is less than the cross-sectional area of said stack.

6. A crucible furnace for melting metals, comprising:

a crucible;

a housing comprising a wall, surrounding said crucible, for forming an annular heating chamber with said crucible and a cap for sealing between said wall and the top of said crucible to enclose said annular heating chamber;

a burner, for producing a pressurized combustion flame, said flame directed into said annular chamber, tangentially against said crucible, and circulating through said annular chamber to heat the exterior surface of said crucible;

exhaust stack means, external to said housing, for conducting hot gases from said enclosed annular chamber, and for providing first and second alternative paths for said gases from said annular chamber, said first path directing said gases from said stack means down into the mouth of said crucible and said second path directing said gases away from the mouth of said crucible, said first and second paths corresponding to first and second operational modes, respectively, of said furnace, said first operational mode heating said crucible by impingement of said hot gases against both the interior and exterior thereof to rapidly melt a solid metal charge, and said second operational mode heating said crucible by impingement of hot gases against exclusively the exterior thereof to reduce hydrogen absorption and oxidation of the molten metal, while maintaining said metal in a molten state; and means, mounted on said exhaust stack means, for selectively alternatively directing hot gases flowing into said exhaust stack means from said annular chamber (a) to the atmosphere through said second path or (b) into the mouth of said crucible through said first path, to change from one of said operational modes to the other.

7. A crucible furnace, as defined in claim 6, wherein said exhaust stack has a first outlet for gases in said first path and a second outlet for gases in said second path, and said means for directing comprises:

a damper for selectively closing said second outlet to force said hot gases to flow out of said stack through said first outlet.

8. A crucible furnace, as defined in claim 6, wherein said exhaust stack is vertically oriented and includes first and second exhaust ports, for exhausting gases from said stack through said first and second paths, respectively, and said means for directing comprises:

means, disposed above said first exhaust port, for (i) closing said second exhaust port to cause said hot gases to be directed through said first exhaust port, and (ii) opening said second exhaust port to cause fumes to be drawn from said crucible through said first exhaust port.

9. A crucible furnace for melting metals, comprising:

a crucible;

a housing, comprising a wall, surrounding said crucible, for forming a heating chamber with said crucible, and a cap for sealing between said wall and the top of said crucible to enclose said chamber;

a burner, sealed to said chamber for producing a pressurized combustion flame, said burner oriented to direct said pressurized combustion flame into said chamber, said flame circulating through said chamber to heat the exterior surface of said crucible;

duct means, sealed to said chamber, for conducting said combustion flame from said chamber through a first duct portion, disposed to direct said flame from said duct means down into the mouth of said crucible to heat the interior of said crucible, and through a second duct portion, disposed to exhaust gases at a location removed from said housing, said first duct portion sized to have a cross sectional area smaller than said second duct portion to provide high temperature stack gain; and flame direction control means, mounted on said duct means, for selectively alternatively directing said flame through one or the other of said duct portions.

10. A crucible furnace for melting metals, as defined by claim 9, wherein said second duct portion comprises a vertical stack.

11. A crucible furnace for melting metals, as defined by claim 9, wherein said first duct portion cross sectional area is less than 50% of said second duct portion cross sectional area.

12. In a crucible furnace having a burner for providing a pressurized combustion flame which circulates through an enclosed annular heating chamber formed by a wall and a cap, sealing between the wall and the top of the crucible to heat exclusively the exterior of the crucible, and having a stack with a first opening for dispensing exhaust gases to the atmosphere, a method of melting metal in said crucible, comprising:

providing a second opening in said stack;

providing a duct from said second opening to the mouth of said crucible;

providing a damper in said stack for opening and closing said first opening;

heating said crucible from both sides to rapidly melt a metal charge therein, and to reduce thermal gradients between the interior and exterior of said crucible by utilizing said damper to close said first opening by an amount sufficient to direct at least a portion of said exhaust gases from said stack, through said second opening and into said crucible; and heating said crucible exclusively from its exterior to reduce hydrogen absorption and oxidation of the molten metal by utilizing said damper to open said first opening by an amount sufficient to direct said exhaust gases through first opening, away from the mouth of said crucible, to prevent said gases from impinging against said metal in said crucibles.

13. A method of melting metals in a crucible, as defined in claim 12, additionally comprising:

utilizing said damper to open said first opening by an amount sufficient to to draw fumes from the mouth of said crucible, through said duct, and into said stack.

14. In a crucible furnace, having a heating chamber, and a burner for providing a pressurized combustion flame which circulates through said chamber, and around a crucible to heat the sides of the crucible, and having means for dispensing exhaust gases, a method of melting metals in said crucible, comprising:

conducting said exhaust gases to the atmosphere to provide a first mode of furnace operation in which said gases flow through a stack portion of said exhaust gas dispensing means;

exhausting said gases from said stack portion at a location removed from the mouth of said crucible;

conducting said exhaust gases into the mouth of said crucible to provide a second mode of operation in which said gases are redirected to flow through a duct portion of said dispensing means;

blocking said flow of said gases through said stack portion to change from said first operational mode to said second operational mode; and constricting the flow of said exhaust gases when said furnace is in said second operational mode relative to the flow when said furnace is in said first operational mode to provide high stack temperature gain.

15. A crucible furnace for melting metal, comprising:

a crucible for containing said metal;

a burner for producing a pressurized combustion flame for heating said crucible;

means for confining said flame and associated hot gases to prevent impingement thereof on said metal, comprising:

a housing, comprising a wall and a cap for sealing between said wall and the top of said crucible, said cap and wall cooperating for form an annular chamber;

an exhaust stack, connected to the exterior of said housing, for conducting gases from said annular chamber to the atmosphere;

said housing and said exhaust stack cooperating to confine said flame and gases to contact said crucible exclusively from the exterior thereof; and means, independent of said housing, mounted on said exhaust stack, for selectively directing gases from said exhaust stack down into the mouth of said crucible to heat said crucible from both the interior and exterior thereof.

16. In a crucible furnace having a burner for providing a pressurized combustion flame which circulates through an enclosed annular heating chamber formed by a wall and a cap sealing between the wall and the top of said crucible, a method of operating said furnace, comprising:

heating said crucible from both the interior and exterior thereof, to rapidly melt a metal change therein, and to reduce thermal gradients between the interior and exterior of said crucible;

heating said crucible exclusively from its exterior to reduce hydrogen absorption and oxidation of molten metal therein; and maintaining said enclosed annular heating chamber in an enclosed condition during both of said heating steps.

17. A method of operating a crucible furnace, comprising:

directing a pressurized combustion flame tangentially to said crucible, said combustion flame producing hot combustion gases;

confining said flame and gases in a heating chamber to heat exclusively the exterior of said crucible;

exhausting gases from said heating chamber to a location remote from the mouth of said crucible to prevent said gases from contacting the interior of said crucible; and selectively directing exhaust gases from said heating chamber into the mouth of said crucible to heat said crucible from both the interior and exterior thereof.

* * * * *